US008146646B1

(12) United States Patent
Toder

(10) Patent No.: US 8,146,646 B1
(45) Date of Patent: Apr. 3, 2012

(54) SYSTEM AND METHOD FOR CONTROLLING MULTIPLE WINDOW COVERINGS USING A SINGLE MANUALLY MANIPULATED CONTROL

(76) Inventor: Ellis Toder, Huntingdon Valley, PA (US)

( * ) Notice: Subject to any disclaimer, the term of this patent is extended or adjusted under 35 U.S.C. 154(b) by 215 days.

(21) Appl. No.: 12/717,929

(22) Filed: Mar. 4, 2010

(51) Int. Cl.
*A47H 1/00* (2006.01)
*A47G 5/02* (2006.01)
*E06B 9/26* (2006.01)

(52) U.S. Cl. ..... 160/120; 160/115; 160/321; 160/310

(58) Field of Classification Search ..... 160/120, 160/126, 85, 86, 115, 309, 310, 321, 323.1
See application file for complete search history.

(56) References Cited

U.S. PATENT DOCUMENTS 2,581,433 A * 1/1952 North et al. ..... 160/120
2,702,081 A * 2/1955 North et al. ..... 160/120
3,980,122 A * 9/1976 Takazawa ..... 160/85
4,418,739 A * 12/1983 Woolnough et al. ..... 160/120
4,621,672 A * 11/1986 Hsu ..... 160/115
4,834,162 A 5/1989 John
5,119,868 A * 6/1992 Werner ..... 160/115
5,392,549 A * 2/1995 Castro ..... 40/518
5,538,065 A * 7/1996 G eraud ..... 160/85
5,845,691 A * 12/1998 Gaines ..... 160/115
6,176,290 B1 * 1/2001 Hsu ..... 160/177 R
6,357,508 B1 * 3/2002 Tronsgard et al. ..... 160/115
7,849,907 B2 * 12/2010 Jang ..... 160/86
8,025,088 B2 * 9/2011 Kim ..... 160/120
2004/0231804 A1 * 11/2004 Ward et al. ..... 160/89
2007/0084568 A1 * 4/2007 Nien ..... 160/85
2009/0173454 A1 * 7/2009 Cheng ..... 160/120

* cited by examiner

*Primary Examiner* — Blair M Johnson
*Assistant Examiner* — Jaime F Cardenas-Garcia
(74) *Attorney, Agent, or Firm* — LaMorte & Associates P.C.

(57) ABSTRACT

A window covering system used to adjust the position of window covers. Each cover hangs from a support that includes a roller. The covers are adjusted in position by the rotation of the roller. A slave gear is attached to each roller to facilitate rotation. A drive gear is provided that is sized to intermesh with each of the slave gears on the rollers. An adjustment mechanism is provided for rotating the drive gear. A second adjustment mechanism is provided for selectively moving the drive gear between various positions. At different points in its movement, the drive gear engages different slave gears from different rollers. Accordingly, a selected roller can be rotated. Thus, a single drive gear and a single manually operated mechanism can be used to individually rotate any number of rollers, thereby adjusting any number of window coverings.

16 Claims, 5 Drawing Sheets

SYSTEM AND METHOD FOR CONTROLLING MULTIPLE WINDOW COVERINGS USING A SINGLE MANUALLY MANIPULATED CONTROL

BACKGROUND OF THE INVENTION

1. Field of the Invention

In general, the present invention relates to systems and methods for adjusting shades, curtains, louvers, blinds and other such window coverings. More particularly, the present invention relates to adjustment mechanisms for such window coverings that are operated by manual controls or by remote control.

2. Prior Art Description

Many windows and doors are protected by shades, curtains, louvers, blinds or other such devices that selectively covering at least part of the window or door. Many of these cover devices are adjustable in position relative to the window or door. For example, a window may have a shade that can be raised or lowered. Likewise, a window may have blinds that can be rotated to allow different amounts of light to pass.

In many prior art systems, the adjustment mechanism for a curtain, shade, blind or louver is controlled by the movement of a flexible cord. The cord hangs from a pulley in the adjustment mechanism. When the cord is pulled, the vertical movement of the cord is transferred to a rotational movement of the pulley. The rotational movement of the pulley within the adjustment mechanism is then utilized to either move a curtain, louver, blind or shade. Such prior art systems are exemplified by U.S. Pat. No. 4,834,162 to John, entitled Vertical Louver Blind Operating Mechanism.

Using a hanging cord to control movements of a curtain, louver, blind or shade has certain inherent problems. The problems increase dramatically if more than one hanging cord is present to control more than one covering. A single cord often tangles upon itself. If a window or door has multiple shades, louvers, curtains and/or blinds with multiple cords, the cords are far more likely to become entangled. Furthermore, a person cannot easily tell which of the many cords belongs to which of the many coverings. As a consequence, a person often opens or closes the wrong shade, louver, curtain, or blind unintentionally.

A need therefore exists for a system where multiple shades, louvers, curtains, and/or blinds can be selectively adjusted using a single adjustment mechanism that is operated by a single cord. This need is met by the present invention as described and claimed below.

SUMMARY OF THE INVENTION

The present invention is a window covering system and the adjustment mechanism used to adjust the position of the window covers used within the window covering system.

Multiple window covers are used within the system. The cover can be a curtain, blind, louver, or shade. Each cover hangs from a support, each including a roller. The covers are adjusted in position by the rotation of the roller. A slave gear is attached to each roller to facilitate the rotation of each roller. The various rollers are held in a parallel orientation within a header box above a window or door.

A drive gear is provided that is sized to intermesh with each of the slave gears on the rollers. A first manually operated mechanism is provided for rotating the drive gear. A second manually operated mechanism is provided for selectively moving the drive gear between various positions. At different points in its movement, the drive gear engages different slave gears from different rollers. It will therefore be understood that the drive gear can be adjusted in position to engage any single slave gear on any single roller. Once in position, the drive gear can be rotated using the first manually operated mechanism. Accordingly, a selected roller can be rotated. Thus, a single drive gear and a single manually operated mechanism can be used to individually rotate any number of rollers, thereby adjusting any number of window coverings.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention adjustment mechanism can be embodied to adjust multiple sets of louvers, curtains, and/or blinds, the embodiment illustrated shows the adjustment mechanism being used to adjust a set of three shades. This embodiment is merely exemplary and should not be considered a limitation when interpreting the scope of the appended claims.

Figure 1:
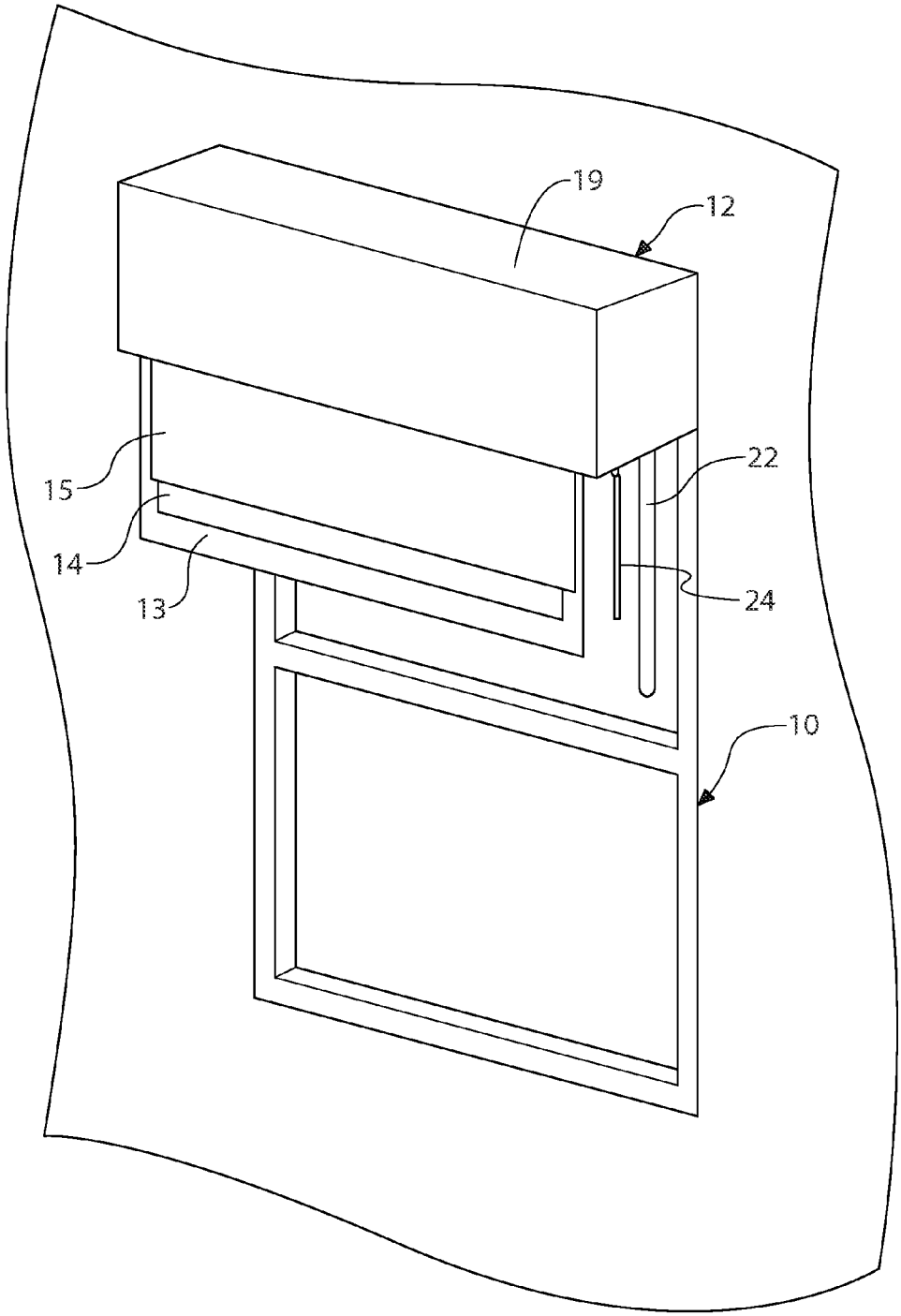
FIG. 1 is a perspective view of an exemplary embodiment of a window having a covering system with multiple covers and a single manual adjustment.
Figure 2:
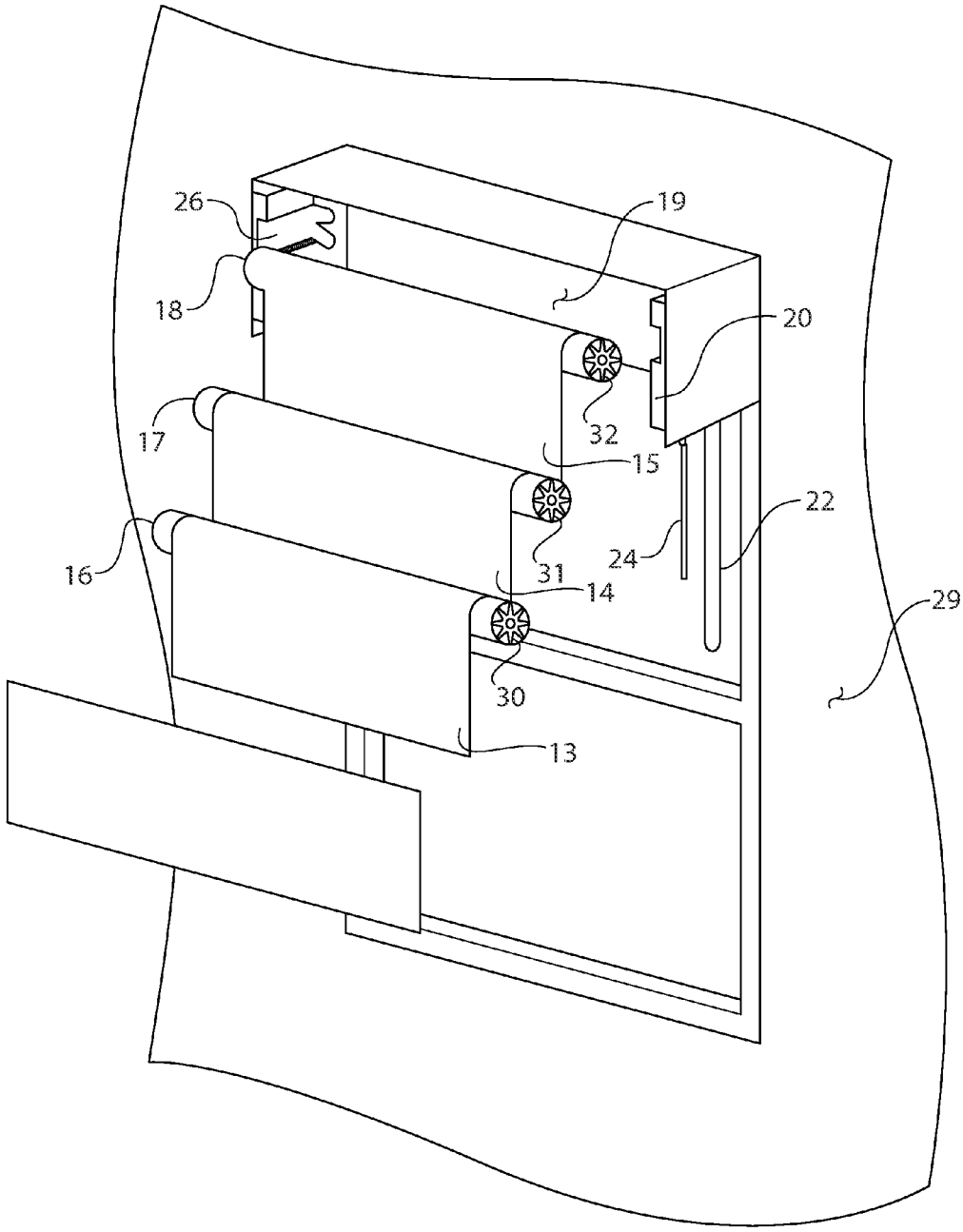
FIG. 2 is an exploded view of the exemplary embodiment shown in FIG. 1.

Referring to FIG. 1 in conjunction with FIG. 2, a window 10 is illustrated that has a complex window covering system 12. The window covering system 12 consists of multiple shades 13, 14, and 15. In the shown embodiment three shades 13, 14, 15 are used. However, it should be understood that any number of window treatments greater than two can be present.

A window covering system may contain multiple shades for a variety of purposes. For example, different shades can have different degrees of translucency. In the shown embodiment, three shades 13, 14, 15 are present. Faux images of a valance, curtain, and decorative shade design are printed on the three shades respectively. In this manner, when all three shades 13, 14, 15 are drawn, the window 10 has the appearance of being fully adorned with formal treatments.

Each of the three shades 13, 14, 15 attach to rollers 16, 17, 18 that are hidden within the confines of a header box 19. As will be explained in greater detail, the three shades 13, 14, 15 are operated using a single adjustment device 20. The single adjustment device 20 has one pulley cord 22 and one twist rod 24. By selectively manipulating the twist rod 24 and pulley cord 22, each of the three shades 13, 14, 15 can be selectively and individually adjusted.

Figure 3:
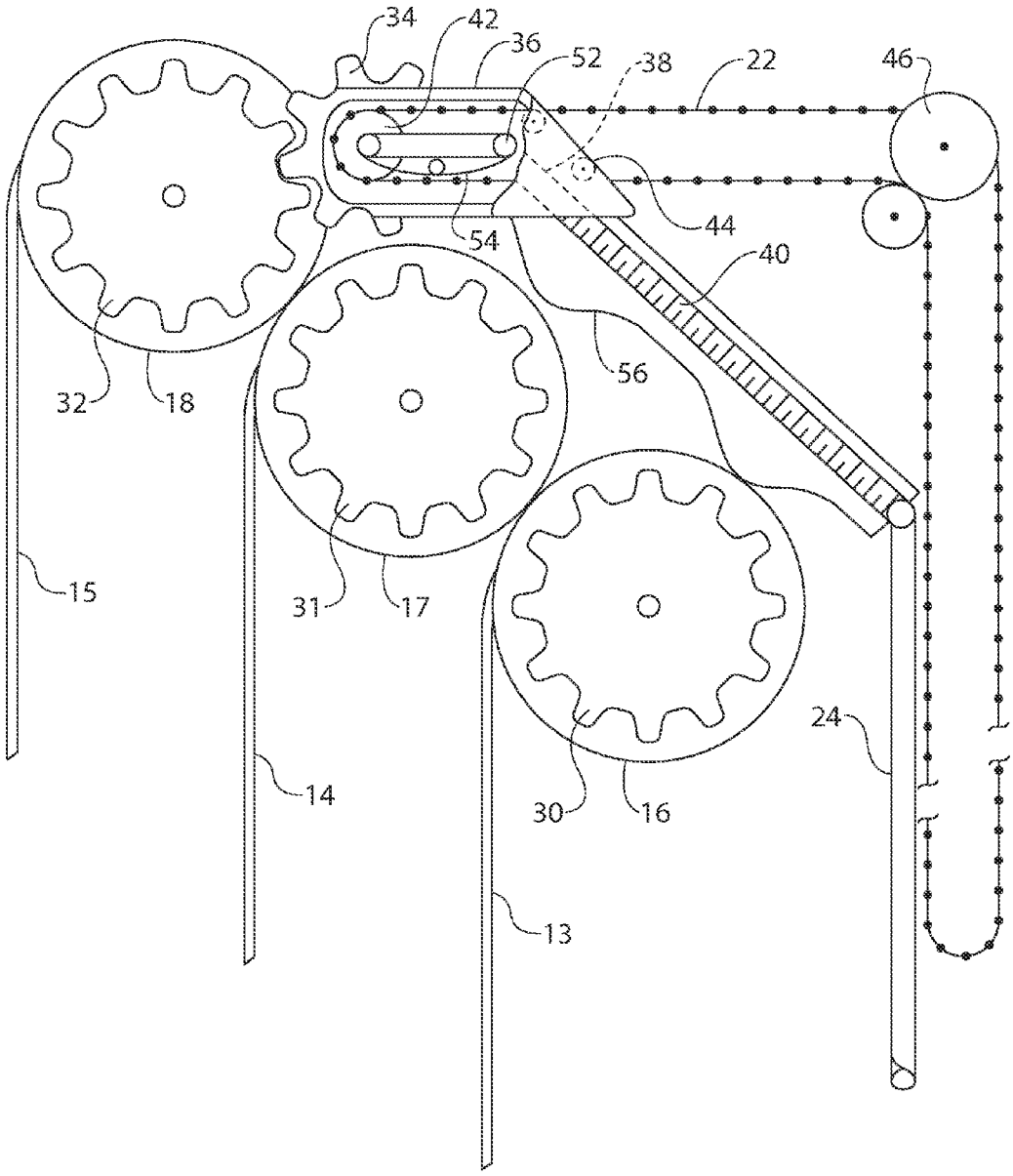
FIG. 3 is a first selectively cross-sectioned view of the adjustment mechanism of the covering system.

Referring to FIG. 3 in conjunction with FIG. 2, it will be understood that each of the shades 13, 14, 15 is attached to its own roller 16, 17, 18. Accordingly, since there are three shades 13, 14, 15, there are three rollers 16, 17, 18. As the rollers 16, 17, 18 rotate, the shades 13, 14, 15 either wind up or unwind down. The rollers 16, 17, 18 are suspended between two end plates 26 at opposite of the header box 19. The rollers 16, 17, 18 are set into the ends of branch slots 28 that hold the three shade rollers 16, 17, 18 at three different distances from the mounting surface 29. In this manner, each of the shades 13, 14, 15 can wind and unwind from its roller 16, 17, 18 without interference.

Each roller 16, 17, 18 has a corresponding slave gear 30, 31, 32 affixed at one end. Each slave gear 30, 31, 32 is attached to a corresponding roller 16, 17, 18 so that the roller 16, 17, 18 turns as its slave gear 30, 31, 32 turns. The three slave gears 30, 31, 32 on the three rollers 16, 17, 18 align in a common plane and are spaced far enough apart not to intermesh.

A drive gear 34 is provided. The drive gear 34 has gear teeth sized and spaced to mesh with the various slave gears 30, 31, 32. The drive gear 34 is mounted to a support arm 36. The support arm 36 contains a threaded hole 38. The treaded hole 38 is engaged by a screw shaft 40. As the screw shaft 40 rotates, the support arm 36 moves along the length of the screw shaft 40. The screw shaft 40 is connected to the twist rod 24. It will therefore be understood that when the twist rod 24 is manually turned, the screw shaft 40 turns. As the screw shaft 40 turns, the support arm 36 moves along the screw shaft 40. The direction of travel for the support arm 36 is dependent upon the direction of manual rotation applied to the twist rod 24.

It will therefore be understood that the twist rod 24 and screw shaft 40 create a manually operated mechanism that selectively moves the support arm 36 along the length of the screw shaft 40. At different points along the screw shaft 40, the drive gear 34 engages the various slave gears 30, 31, 32 at the ends of the rollers 16, 17, 18.

The drive gear 34 has a hub 42. The pulley cord 22 engages the hub 42 of the drive gear 34. When the cord 22 is pulled, the drive gear 34 is caused to turn. The cord 22 extends from the drive gear 34 to a set of guide wheels 44 and fixed pulleys 46. The guide wheels 44 and pulleys 46 reorient the cord 22 into the vertical, wherein the cord 22 hangs straight down below the header box 19.

Figure 4:
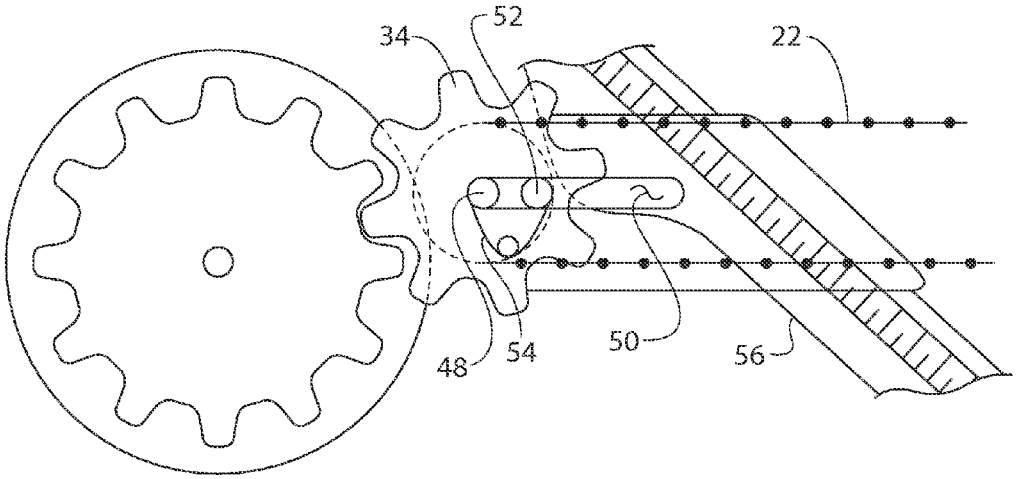
FIG. 4 is an enlarged selectively cross-sectioned view of the adjustment mechanism of the covering system.

Referring to FIG. 4 in conjunction with FIG. 3, it can be seen that the drive gear 34 rotates about a central axle 48. The axle 48 is set in an elongated guide 50 that enables the drive gear 34 to move back and forth within the elongated guide 50 while rotating. A cam pin 52 is set in the elongated guide 50. The cam pin 52 is also free to move back and forth within the elongated guide 50. The drive gear 34 is biased away from the cam pin 52 by a spring 54. Accordingly, due to the force of the spring 54, the axle 48 of the drive gear 34 and the cam pin 52 typically are disposed at opposite ends of the elongated guide 50, such as is shown in FIG. 2.

The three slave gears 30, 31, 32 are at three distances from the screw shaft 40, respectively. The ability of the drive gear 34 to move back and forth in the elongated guide 50 enables the drive gear 34 to be at any of the three distances from the screw shaft 40. Consequently, the drive gear 34 is capable of engaging each of the slave gears 30, 31, 32 as the support arm 36 travels along the screw shaft 40. A contoured cam surface 56 extends forward of the screw shaft 40. As the support arm 36 moves along the screw shaft 40, the cam pin 52 moves along the contoured cam surface 56 while remaining in constant contact with the contoured cam surface 56.

The contoured cam surface 56 includes bulged areas 58 proximate the slave gears 30, 31, 32 of the rollers. The bulged areas 58 force the cam pin 52 to move toward the drive gear 34. See FIG. 4. The movement of the cam pin 52 compresses the spring 54. The spring 54, therefore, presses against the drive gear 34 with greater force. The force applied by the spring 54 maintains the drive gear 34 in contact with the various slave gears 30, 31, 32 and prevents the drive gear 34 from moving out of position when the pulley cord 22 is pulled.

It will therefore be understood that the drive gear 34 and pulley cord 22 create a manually operated mechanism that selectively rotates the drive gear 34 and any slave gear that may be intermeshed with the drive gear 34.

To utilize the invention, a person grasps and turns the twist rod 24. This causes the screw shaft 40 to turn, which causes the support arm 36 to move along the screw shaft 40. By moving the support arm 36, the drive gear 34 can be selectively moved between a first position, where it engages the slave gear 30 of the first roller 16, a second position where it engages the slave gear 31 of the second roller 17, and a third position where it engages the slave gear 32 of the third roller 18. It may be possible to create the drive gear 34 with a large enough size so that it can engage two of the slave gears at the same time.

Once the drive gear 34 is moved to a position where it engages a selected slave gear and roller, one or the other of the two sides of the hanging pulley cord 22 is pulled. The movement of the pulley cord 22 causes the drive gear 34 to rotate either in a clockwise direction or a counterclockwise direction. The rotational movement of the drive gear 34 is transferred to the engaged slave gear and the corresponding roller. The roller then either raises or lowers the shade. If a louver or blind is used instead of a shade, the rotational movement of the slave gear is used to selectively open or close the louver or blind.

Figure 5:
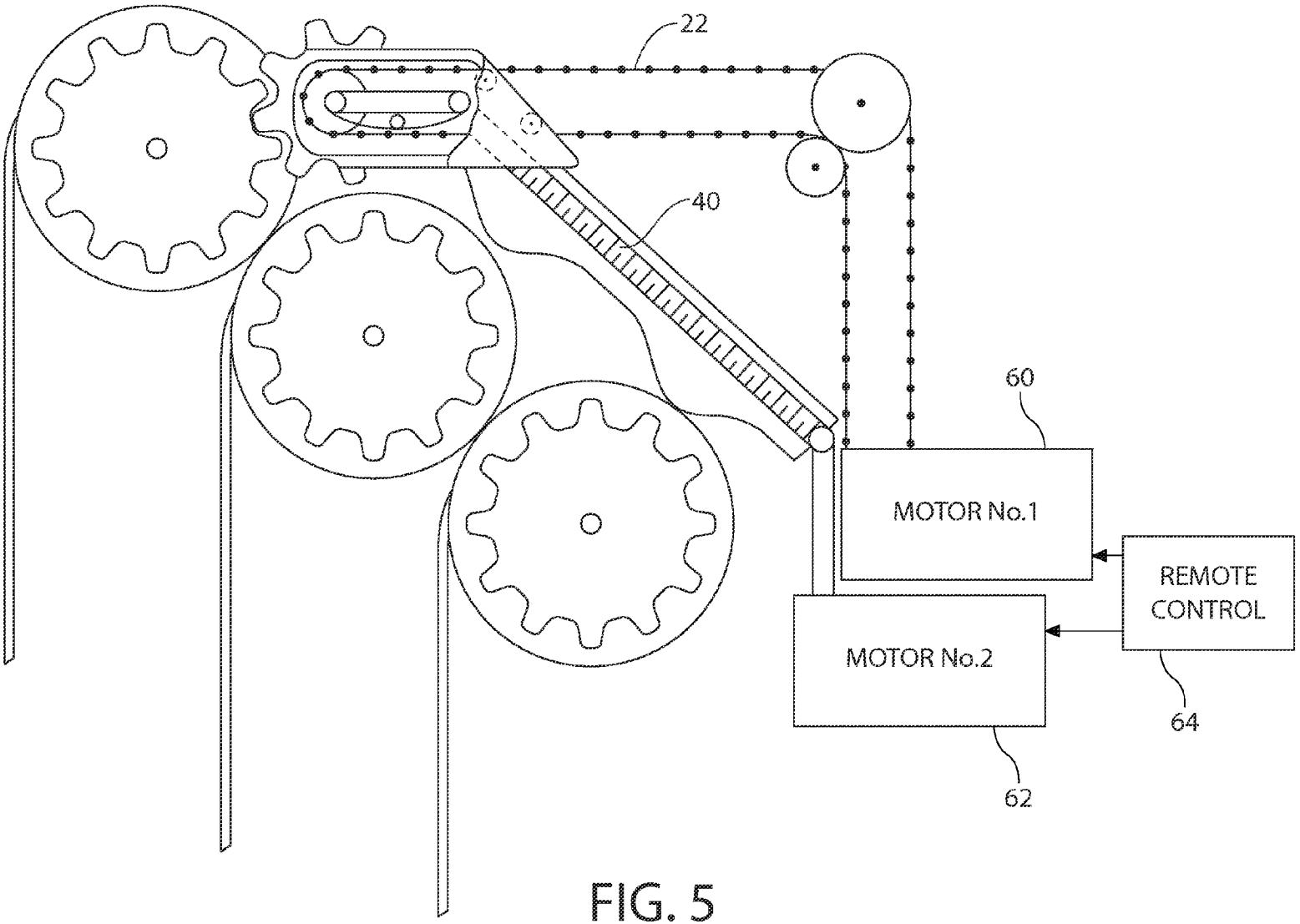
FIG. 5 is an alternate embodiment of the adjustment mechanism shown in FIG. 4.

Referring to FIG. 5, an alternate embodiment of the adjustment mechanisms is shown. In the embodiment of FIG. 5, motors 60, 62 are provided to remove the need for manual manipulation. The motors 60, 62 are controlled using a remote control unit 64. The first motor 60 selectively moves the pulley cord 22. The second motor selectively rotates the screw shaft 40. The movements of the screw shaft 40 and the pulley cord 22 function to adjust the shades in the same manner as was previously described with reference to FIG. 4.

In the illustrated embodiment, three shades 13, 14, 15 are used. It will be understood that the adjustment mechanisms of the present invention can be used to adjust any plurality of shades, curtains, blinds and/or louvers mounted in a single header box. Accordingly, it will be understood that the embodiment of the present invention that is illustrated and described is merely exemplary and that a person skilled in the art can make many variations to that embodiment. All such embodiments are intended to be included within the scope of the present invention as defined by the claims.

What is claimed is:

1. An assembly comprising:

a plurality of rollers that include a first roller and a second roller;

a first cover affixed to said first roller; a second cover affixed to said second roller;

a header box for holding said first roller and said second roller in a parallel orientation;

a drive gear for selectively and independently rotating said first roller and said second roller, respectively;

a first adjustment mechanism for rotating said drive gear, said first adjustment mechanism for rotating said drive gear includes a pulley cord;

a second adjustment mechanism for selectively moving said drive gear between a first position and a second position, wherein rotation of said drive gear in said first position causes rotation in said first roller; and wherein rotation of said drive gear in said second position causes rotation of said second roller.

2. The assembly according to claim 1, further including a first gear connected to said first roller that turns with said first roller, and a second gear coupled to said second roller that turns with said second roller.

3. The assembly according to claim 2, wherein said drive gear intermeshes with said first gear when in said first position.

4. The assembly according to claim 3, wherein said drive gear intermeshes with said second gear when in said second position.

5. The assembly according to claim 1, further including a third roller that supports a third cover, wherein said third roller is held in a parallel orientation with said first roller in said header box.

6. The assembly according to claim 5, wherein said second adjustment mechanism can selectively move said drive gear to a third position, wherein rotation of said drive gear in said third position causes rotation in said third roller.

7. The assembly according to claim 1, wherein said first cover and said second cover are selected from a group consisting of curtains, shades, blinds and louvers.

8. The assembly according to claim 1, wherein said first adjustment mechanism for selectively moving said drive gear includes a twist rod.

9. In a window cover system having a plurality of rollers held within a common header box, an adjustment device for selectively rotating said rollers, comprising:

a drive gear selectively rotated by a first adjustment mechanism;

a screw shaft selectively rotated by a second adjustment mechanism, wherein said drive gear is coupled to said screw shaft and moves along said screw shaft to different positions as said screw shaft is turned by said second adjustment mechanism;

wherein said drive gear engages selectively and independently different rollers from said plurality of rollers as said drive gear moves to said different positions; and wherein said drive gear rotates any one of said plurality of rollers engaged with said drive gear when said drive gear is rotated by said second adjustment mechanism.

10. The device according to claim 9, wherein said drive gear is supported by a support arm, wherein said support arm engages said screw shaft and moves along said screw shaft when said screw shaft is rotated.

11. The device according to claim 10, wherein said drive gear rotates about an axle and said axle is disposed in an elongated guide within said support arm that enables said axle and said drive gear to move back and forth within said elongated guide.

12. The device according to claim 11, further including a spring for biasing said axle of said drive gear to one end of said elongated guide.

13. The device according to claim 12, further including a pin that engages said elongated guide.

14. The device according to claim 13, wherein said spring biases said drive gear away from said pin.

15. The device according to claim 14, further including a contoured cam surface that extends along at least part of said screw shaft.

16. The device according to claim 15, wherein said pin is moved by said cam surface in said elongated guide as said support arm moves along said screw shaft.

* * * * *